US012727614B2

(12) United States Patent
Ibrahim

(10) Patent No.: US 12,727,614 B2
(45) Date of Patent: Sep. 8, 2026

(54) TOBACCO COMPOSITION

(71) Applicant: NICOVENTURES TRADING LIMITED, London (GB)

(72) Inventor: Hasnol Ibrahim, London (GB)

(73) Assignee: NICOVENTURES TRADING LIMITED, London (GB)

( * ) Notice: Subject to any disclaimer, the term of this patent is extended or adjusted under 35 U.S.C. 154(b) by 235 days.

(21) Appl. No.: 16/060,308

(22) PCT Filed: Dec. 7, 2016

(86) PCT No.: PCT/EP2016/080101
§ 371 (c)(1),
(2) Date: Jun. 7, 2018

(87) PCT Pub. No.: WO2017/097840
PCT Pub. Date: Jun. 15, 2017

(65) Prior Publication Data

US 2018/0360099 A1 Dec. 20, 2018

(30) Foreign Application Priority Data

Dec. 8, 2015 (GB) ..... 1521626

(51) Int. Cl.
*A24B 15/12* (2006.01)
*A24B 15/16* (2020.01)
(Continued)

(52) U.S. Cl.
CPC ..... *A24B 15/12* (2013.01); *A24B 15/165* (2013.01); *A24B 15/243* (2013.01); *A24B 15/32* (2013.01); *A24D 1/20* (2020.01); *A24F 7/04* (2013.01)

(58) Field of Classification Search
CPC ..... A24B 13/00; A24B 15/14; A24B 3/14; A24C 5/18; A24F 47/004
See application file for complete search history.

(56) References Cited

U.S. PATENT DOCUMENTS 3,076,729 A 2/1963 Garbo
3,385,303 A 5/1968 Hind
(Continued)

FOREIGN PATENT DOCUMENTS

CL 40393 11/1992
CL 48548 B1 1/2002
(Continued)

OTHER PUBLICATIONS

Great Britain Search Report, Application No. GB1521626.0, 3 pages.
(Continued)

*Primary Examiner* — Dionne W. Mayes
(74) *Attorney, Agent, or Firm* — WOMBLE BOND DICKINSON (US) LLP

(57) ABSTRACT

Provided herein is a tobacco composition including a tobacco component in an amount of from 60 to 90% by weight of the tobacco composition, a filler component in an amount of from 0 to 20% by weight of the tobacco composition, and an aerosol generating agent in an amount of from 10 to 20% by weight of the tobacco composition, wherein the tobacco composition has a nicotine content of from 0.5 to 1.5% by weight of the tobacco composition, and wherein the tobacco component comprises paper reconstituted tobacco in an amount of from 70 to 100% by weight of the tobacco component.

12 Claims, 5 Drawing Sheets

(51) Int. Cl.

| | |
|---|---|
| ***A24B 15/24*** | (2006.01) |
| ***A24B 15/32*** | (2006.01) |
| ***A24D 1/20*** | (2020.01) |
| ***A24F 7/04*** | (2006.01) |

(56) References Cited

U.S. PATENT DOCUMENTS

| | | | | |
|---|---|---|---|---|
| 3,415,253 | A | 12/1968 | Michels et al. | |
| 3,934,594 | A | 1/1976 | Beringer | |
| 5,060,671 | A | 10/1991 | Counts | |
| 5,074,321 | A | 12/1991 | Gentry | |
| 5,249,588 | A | 10/1993 | Brown | |
| 6,508,254 | B1 | 1/2003 | Mua et al. | |
| 8,353,302 | B2 | 1/2013 | Olegario et al. | |
| 2003/0159703 | A1* | 8/2003 | Yang et al. | A24D 1/002 131/335 |
| 2004/0226568 | A1 | 11/2004 | Takeuchi et al. | |
| 2005/0000532 | A1 | 1/2005 | Bereman | |
| 2005/0005947 | A1* | 1/2005 | Hampl, Jr. et al. | A24D 1/02 131/360 |
| 2005/0263161 | A1 | 12/2005 | Mua | |
| 2007/0074734 | A1* | 4/2007 | Braunshteyn et al. | A24F 13/00 131/328 |
| 2008/0092912 | A1 | 4/2008 | Robinson | |
| 2008/0216851 | A1 | 9/2008 | Olegario | |
| 2008/0216854 | A1 | 9/2008 | Nicholls | |
| 2009/0151739 | A1* | 6/2009 | Borschke et al. | A24F 47/004 131/365 |
| 2015/0150302 | A1* | 6/2015 | Metrangolo et al. | A24B 13/00 131/77 |
| 2015/0320107 | A1 | 11/2015 | Dube et al. | |
| 2015/0359264 | A1* | 12/2015 | Fernando et al. | H01J 49/0036 250/281 |
| 2017/0042221 | A1 | 2/2017 | England | |

FOREIGN PATENT DOCUMENTS

| | | | | |
|---|---|---|---|---|
| CL | 200101963 | | 7/2002 | |
| CL | 46338 | B1 | 5/2006 | |
| CN | 103222675 | A | 7/2013 | |
| CN | 104411191 | A | 3/2015 | |
| EA | 13933 | B1 | 8/2010 | |
| EP | 0336458 | | 10/1989 | |
| EP | 2 644 043 | A1 | 2/2013 | |
| FR | 2287183 | | 5/1976 | |
| FR | 3041507 | B1 | 3/2017 | |
| GB | 1481056 | | 7/1977 | |
| GB | 2203022 | | 10/1988 | |
| JP | H057485 | A | 1/1993 | |
| JP | 2004520818 | A | 7/2004 | |
| JP | 2013502232 | A1 | 1/2013 | |
| JP | 2015517817 | A | 6/2015 | |
| RU | 2268631 | C1 | 1/2006 | |
| WO | WO8902227 | | 3/1989 | |
| WO | WO0028842 | | 5/2000 | |
| WO | 0165954 | A1 | 9/2001 | |
| WO | 2004093823 | A2 | 11/2004 | |
| WO | WO2007036814 | A2 | 4/2007 | |
| WO | WO2009079641 | | 6/2009 | |
| WO | WO2010125386 | | 11/2010 | |
| WO | WO2010125387 | | 11/2010 | |
| WO | WO2011022431 | | 2/2011 | |
| WO | 2011028372 | A1 | 3/2011 | |
| WO | WO2011045609 | | 4/2011 | |
| WO | WO2012016795 | | 2/2012 | |
| WO | 2012/110819 | A1 | 8/2012 | |
| WO | WO2013104914 | | 7/2013 | |
| WO | 2013/178769 | A1 | 12/2013 | |
| WO | WO2013178766 | | 12/2013 | |
| WO | WO2015025158 | A1 | 2/2015 | |
| WO | WO2015055567 | | 4/2015 | |
| WO | WO2015062983 | * | 5/2015 | H05B 1/0291 |
| WO | WO2015071682 | A1 | 5/2015 | |
| WO | WO2015166245 | | 11/2015 | |
| WO | WO2015166248 | A1 | 11/2015 | |
| WO | 2017/051034 | A1 | 3/2017 | |

OTHER PUBLICATIONS

International Search Report and Written Opinion, Application No. PCT/EP2016/080101, mailed Mar. 23, 2017, 16 pages.

Russian Office Action, Russian Application No. 2018121101, mailing date May 21, 2019, 9 pages.

Chilean Office Action, Chilean Application No. 201801496, mailing date: Jun. 17, 2019, 8 pages.

Indonesian Office Action, Application No. WO2015166248A1, mailing date: Aug. 21, 2019, 2 pages.

Japanese Office Action, Japanese Application No. 2018-526780, mailing date: Aug. 27, 2019, 7 pages.

Japanese Office Action, Japanese Application No. 2018-526780, mailing date May 12, 2020, 3 pages.

International Preliminary Report on Patentability for Application No. PCT/EP2016/080101, mailed on Jun. 21, 2018, 7 pages.

Benowitz et al "Nicotine Chemistry, Metabolism, Kinetics and Biomarkers"—Handbook Exp Pharmacol. 2009; (192): 29-60.

Reconstituted (Sheet) Tobaccos, Feb. 26, 1993 (available at https://www.industrydocuments.ucsf.edu/tobacco/docs/#id=rhgp0034, document added on the UCSF website on Aug. 6, 2009).

Reconstituted Tobaccos, Aug. 10, 1995 (available at https://www.industrydocuments.ucsf.edu/tobacco/docs/#id=nlhx0093, document added to the UCSF website on Jul. 9, 2002).

A Comparison of Reconstituted Tobaccos Made by Five Processes Project T6533 issued on Mar. 2, 1971 (available at https://www.industrydocuments.ucsf.edu/tobacco/docs/#id=rkpy0131, document added to the UCSF website on Feb. 1, 2002).

Analytical and Sensory Comparison of Several Virgin Recons/329 of Aug. 15, 1991 (available at https://www.industrydocuments.ucsf.edu/tobacco/docs/#id=frjb0 147, document added to the UCSF website on Feb. 1, 2002).

Excerpt from "Tobacco", B.C. Akehurst, 2" Edition, 1981.

Gorod et al, (1999), "Analytical determination of nicotine and related compounds and their metabolites", Elsevier (p. 323).

Leffingwell, J.C. et al. (1999), "Chapter 8 Leaf Chemistry—Basic chemical constituents of tobacco leaf and differences among tobacco types", (Blackwell Science (Pub), pp. 265-284).

* cited by examiner

TOBACCO COMPOSITION

PRIORITY CLAIM

The present application is a National Phase entry of PCT Application No. PCT/EP2016/080101, filed Dec. 7, 2016, which claims priority from GB Patent Application No. 1521626.0, filed Dec. 8, 2015, each of which is hereby fully incorporated herein by reference.

TECHNICAL FIELD

The present disclosure relates to a tobacco composition, in particular for use in a tobacco heating product (THP).

BACKGROUND

Articles such as cigarettes, cigars and the like burn tobacco during use to create tobacco smoke. Attempts have been made to provide alternatives to these types of articles, which burn tobacco, by creating products that release compounds without burning. Examples of such products are so-called heat-not-burn products, also known as tobacco heating products or tobacco heating devices, which release compounds by heating, but not burning, the material. The material may be for example tobacco or other non-tobacco products or a combination, such as a blended mix, which may or may not contain nicotine.

Apparatuses are known that heat smokable material to volatilize at least one component of the smokable material, typically to form an aerosol which can be inhaled, without burning or combusting the smokable material. Such apparatuses are sometimes described as a "heat-not-burn" apparatuses or "tobacco heating products" (THPs) or "tobacco heating devices" or similar. Various different arrangements for volatilizing at least one component of the smokable material are known.

SUMMARY

According to a first aspect, there is provided a tobacco composition comprising a tobacco component in an amount of from 60 to 90% by weight of the tobacco composition, a filler component in an amount of from 0 to 20% by weight of the tobacco composition, and an aerosol generating agent in an amount of from 10 to 20% by weight of the tobacco composition; wherein the tobacco composition has a nicotine content of from 0.5 to 1.5% by weight of the tobacco composition; and wherein the tobacco component comprises paper reconstituted tobacco in an amount of from 70 to 100% by weight of the tobacco component.

In embodiments, the tobacco component may contain a component selected from leaf tobacco, extruded tobacco, bandcast tobacco, and mixtures thereof, in an amount of from 0 to 30% by weight of the tobacco component.

In embodiments, the aerosol generating agent may comprise an agent selected from sorbitol, glycerol, propylene glycol, triethylene glycol, lactic acid, diacetin, triacetin, triethylene glycol diacetate, triethyl citrate, ethyl myristate, isopropyl myristate, methyl stearate, dimethyl dodecanedioate, dimethyl tetradecanedioate, and mixtures thereof.

In embodiments, the aerosol generating agent may comprise glycerol and propylene glycol.

In embodiments, the tobacco component may contain leaf tobacco in an amount of from 10 to 30% by weight of the tobacco composition.

In embodiments, the tobacco component may contain extruded tobacco in an amount of from 10 to 30% by weight of the tobacco composition.

In embodiments, the tobacco component may contain bandcast tobacco in an amount of from 10 to 30% by weight of the tobacco composition.

According to a second aspect, there is provided a device for generating an inhalable aerosol, the device comprising a tobacco composition as described herein and a heating means which volatilizes components in use to form an aerosol.

In embodiments, the heating means is an electrical heating means.

In embodiments, the electrical heating means is an electrically resistive heating element.

In embodiments, the device is a tobacco heating product.

According to a third aspect, there is provided a smoking article for use with an apparatus for heating smokable material, the smoking article comprising a smokable material comprising a tobacco composition as described herein and a mouthpiece attached to one end of the smokable material.

In embodiments, the mouthpiece comprises a hollow tube.

In embodiments, the smoking article comprises an aerosol-cooling element between the smokable material and the mouthpiece for cooling volatilized smokable material produced when the smokable material is heated.

In embodiments, the smoking article comprises a spacer between the smokable material and the aerosol-cooling element.

In embodiments the spacer is a hollow spacer tube.

According to a fourth aspect, there is provided a cartridge for use with an apparatus for heating smokable material, the cartridge containing smokable material comprising a tobacco composition as described herein.

Further features and advantages of the invention will become apparent from the following description of preferred embodiments of the invention, given by way of example only, which is made with reference to the accompanying drawings.

DETAILED DESCRIPTION

Figure 1:
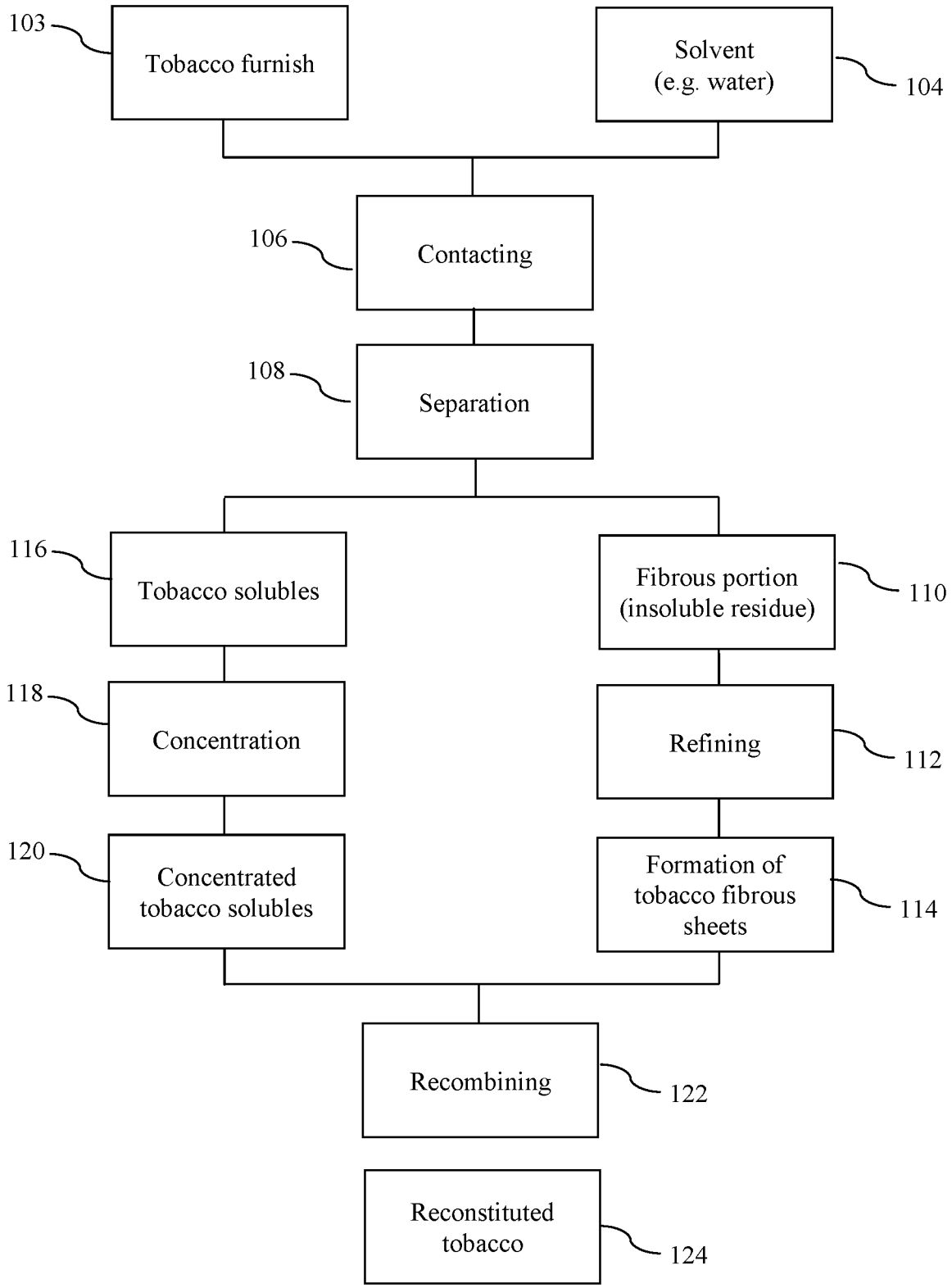
FIG. 1 shows a flowchart for a process for making paper reconstituted tobacco.

In the tobacco compositions described herein, the tobacco component contains paper reconstituted tobacco. The tobacco component may also contain leaf tobacco, extruded tobacco, and/or bandcast tobacco.

In the tobacco compositions described here, the tobacco composition may contain a filler component. The filler component is generally a non-tobacco component, that is, a component that does not include ingredients originating from tobacco. The filler component may be a non-tobacco fiber such as wood fiber or pulp or wheat fiber. The filler component may also be an inorganic material such as chalk, perlite, vermiculite, diatomaceous earth, colloidal silica, magnesium oxide, magnesium sulphate, or magnesium carbonate. The filler component may also be a non-tobacco cast material or a non-tobacco extruded material. The filler component may be present in an amount of from 0 to 20% by weight of the tobacco composition, or in an amount of from 1 to 10% by weight of the composition. In some embodiments, the filler component is absent.

In the tobacco compositions described herein, the tobacco composition contains an aerosol generating agent. In this context, an "aerosol generating agent" is an agent that promotes the generation of an aerosol. An aerosol generating agent may promote the generation of an aerosol by promoting an initial vaporization and/or the condensation of a gas to an inhalable solid and/or liquid aerosol. In some embodiments, an aerosol generating agent may improve the delivery of flavor from the aerosol generating material.

In general, any suitable aerosol generating agent or agents may be included in the aerosol generating material. Suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate.

In some embodiments, the aerosol generating agent may be glycerol, propylene glycol, or a mixture of glycerol and propylene glycol. Glycerol may be present in an amount of from 10 to 20% by weight of the tobacco composition, for example from 13 to 16% by weight of the composition, or from 14 to 15% by weight of the composition. Propylene glycol, if present, may be present in an amount of from 0.1 to 0.3% by weight of the composition.

The aerosol generating agent may be included in any component, for example any tobacco component, of the tobacco composition, and/or in the filler component, if present. Alternatively or additionally the aerosol generating agent may be added to the tobacco composition separately. In either case, the total amount of the aerosol generating agent in the tobacco composition should be as defined herein.

The tobacco compositions described herein contain nicotine. The nicotine content is from 0.5 to 1.5% by weight of the tobacco composition, and may be, for example, from 0.8 to 1.2% by weight of the tobacco composition. In embodiments, the nicotine content may be from 0.8 to 1.0% by weight of the tobacco composition. It has been surprisingly found that, when used in a tobacco heating product, if the nicotine content is too high, a harsh sensation may be produced in use when the aerosol is inhaled.

In the compositions described herein, where amounts are given in % by weight, for the avoidance of doubt this refers to a dry weight basis, unless specifically indicated to the contrary. Thus, any water that may be present in the tobacco composition, or in any component thereof, is entirely disregarded for the purposes of the determination of the weight %. The water content of the tobacco compositions described herein may vary and may be, for example, from 5 to 15% by weight. The water content of the tobacco compositions described herein may vary according to, for example, the temperature, pressure and humidity conditions at which the compositions are maintained. The water content can be determined by Karl-Fisher analysis, or by gas chromatography, as described herein.

On the other hand, for the avoidance of doubt, even when the aerosol generating agent is a component that is in liquid phase, such as glycerol or propylene glycol, any component other than water is included in the weight of the tobacco composition. However, when the aerosol generating agent is provided in the tobacco component of the tobacco composition, or in the filler component (if present) of the tobacco composition, instead of or in addition to being added separately to the tobacco composition, the aerosol generating agent is not included in the weight of the tobacco component or filler component, but is included in the weight of the "aerosol generating agent" in the weight % as defined herein. All other ingredients present in the tobacco component are included in the weight of the tobacco component, even if of non-tobacco origin (for example non-tobacco fibers in the case of paper reconstituted tobacco).

In an embodiment, the tobacco composition comprises the tobacco component as defined herein and the aerosol generating agent as defined herein. In an embodiment, the tobacco composition consists essentially of the tobacco component as defined herein and the aerosol generating agent as defined herein. In an embodiment, the tobacco composition consists of the tobacco component as defined herein and the aerosol generating agent as defined herein.

Paper Reconstituted Tobacco

Paper reconstituted tobacco is present in the tobacco component of the tobacco compositions described herein in an amount of from 70 to 100% by weight of the tobacco component. In embodiments, the paper reconstituted tobacco is present in an amount of from 80 to 100% by weight, or from 90 to 100% by weight, of the tobacco component. In a further embodiment, the tobacco component consists essentially of, or consists of, paper reconstituted tobacco.

Paper reconstituted tobacco refers to tobacco material formed by a process in which tobacco feedstock is extracted with a solvent to afford an extract of solubles and a residue comprising fibrous material, and then the extract (usually after concentration, and optionally after further processing) is recombined with fibrous material from the residue (usually after refining of the fibrous material, and optionally with the addition of a portion of non-tobacco fibers) by deposition of the extract onto the fibrous material. The process of recombination resembles the process for making paper.

The paper reconstituted tobacco may be any type of paper reconstituted tobacco that is known in the art. In a particular embodiment, the paper reconstituted tobacco is made from a feedstock comprising one or more of tobacco strips, tobacco stems, and whole leaf tobacco. In a further embodiment, the paper reconstituted tobacco is made from a feedstock consisting of tobacco strips and/or whole leaf tobacco, and tobacco stems. However, in other embodiments, scraps, fines and winnowings can alternatively or additionally be employed in the feedstock.

The paper reconstituted tobacco for use in the tobacco compositions described herein may be prepared by methods which are known to those skilled in the art for preparing paper reconstituted tobacco.

In some embodiments, paper reconstituted tobacco can be prepared as follows.

Referring to FIG. 1, tobacco is furnished 103, such as leaf, strips, stems, scraps, fines, and/or winnowings (in some embodiments, leaf, strips and stems), and is initially mixed with an aqueous solvent 104 (e.g., [water, water and water miscible solvents such as ethanol). Distilled water, deionized water, or tap water may be employed. The suspension of tobacco in the solvent at 106 is agitated by stirring or shaking for instance in order to increase the rate of extraction of the soluble portion from the fibrous portion of tobacco. The agitation is typically carried out for half an hour up to 6 hours. Agitation may be achieved in an agitator that comprises a vessel and a blade to achieve agitation. The amount of solvent in the suspension can vary widely from about 75 to 99% by weight of the suspension, depending on the tobacco furnish, the type of solvent and agitation equipment (in particular the blade type), and the temperature of the suspension. The typical range of suspension temperature is about 10° C. to about 100° C.

The soluble portion of the tobacco furnish is separated from the insoluble fibrous portion of tobacco at 108, for example by pressing with a pneumatic, hydraulic or mechanical press, or by filtration.

After the separation 108, the fibrous portion 110 of tobacco is typically subjected to mechanical refining 112 to produce a fibrous pulp. Suitable refiners can be typically disc refiners or conical refiners. At 114, the fibrous pulp will be then formed into a base web comprising the tobacco fibrous pulp on a papermaking station, such as a Fourdrinier-type papermaking machine. It is typically laid onto a flat wire belt where excess water is removed by gravity drain and suction drain. Non-tobacco fiber, such as cellulose, wheat fiber or wood fiber, may be included with the tobacco-derived fibrous portion at this stage.

The soluble portion of the tobacco feedstock 116 is concentrated at 118 using any known type of concentrator such as film evaporator or vacuum evaporator. After concentration 118, ingredients such as aerosol generating agents (as defined herein), casings, for example cocoa, liquorice, and acids such as malic acid, or flavors (as defined herein) may be added and mixed with the concentrated tobacco solubles 120.

Then concentrated tobacco solubles 120 potentially containing aerosol generating agents and/or casings and/or flavors are recombined at 122 with the dried tobacco fibrous sheet 114 to form reconstituted tobacco 124. The concentrated solubles 120 can be added back at 122 to the fibrous web 114 with various methods, such as spraying, coating, saturating, sizing.

Finally, the reconstituted tobacco 124 is dried. It may optionally be cut into strips or wound into a roll and then slit into bobbins or shredded into cut rag.

As used herein, the terms "flavor" and "flavoring" refer to materials which, where local regulations permit, may be used to create a desired taste or aroma in a product for adult consumers. They may include extracts (e.g., licorice, *hydrangea*, Japanese white bark *magnolia* leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, *cassia*, caraway, cognac, jasmine, ylang-ylang, sage, fennel, chili pepper, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

Examples of paper reconstituted tobacco that may be used are as follows in Table 1.

TABLE 1

Paper Reconstituted Tobacco

| | | Component Range | | PR-1 | P2-2 |
|---|---|---|---|---|---|
| Type | Ingredient | Low % | High % | ww % | ww % |
| Tobacco | Virginia | 50 | 80 | 78 | 50 |
| | Burley | 0 | 20 | — | 17 |
| | Oriental | 0 | 15 | — | 11 |
| | Others | 0 | 15 | — | — |
| | Total | | | 78 | 78 |
| | | | | — | — |
| Fiber | Wood pulp | 0 | 10 | 7 | 7 |
| | | | | — | — |
| Aerosol Agent | Glycerol | 10 | 20 | 15 | 15 |
| | | | | — | — |
| Casing/Flavor | — | 0 | 5 | — | — |
| | Total all | | | 100 | 100 |
| Moisture (water) | | 5 | 15 | 9 | 9 |

Leaf Tobacco

Leaf tobacco may optionally be included in the tobacco compositions described herein. If leaf tobacco is included, it may be present, for example, in an amount of from 10 to 30% by weight, or 10 to 20% by weight, of the tobacco component.

The leaf tobacco which may be used in the tobacco compositions described herein may be any suitable tobacco, such as single grades or blends, cut rag or whole leaf, including Virginia (flue-cured) and/or Burley and/or Oriental.

The leaf tobacco may include ingredients such as aerosol generating agents (as defined herein), casings (as defined herein) and flavors (as defined herein).

Extruded Tobacco

Extruded tobacco may optionally be included in the tobacco compositions described herein. If extruded tobacco is included, it may be present, for example, in an amount of from 10 to 30% by weight, or from 10 to 20% by weight, of the tobacco component.

The extruded tobacco which may be used in the tobacco compositions described herein may be prepared by methods which are known to those skilled in the art for preparing extruded tobacco.

In some embodiments, extruded tobacco can be prepared as follows.

The tobacco furnish may include Virginia (flue cured) tobacco, Burley tobacco, and/or Oriental tobacco. The tobacco furnish may be stems, scraps, strips, fines, or winnowings.

Additional components may include non-tobacco fiber, such as straw fiber or wheat fibers; binders, for example celluloses or modified celluloses such as hydroxypropyl cellulose and carboxymethylcellulose; and casings, for example acids such as malic acid.

Figure 2:
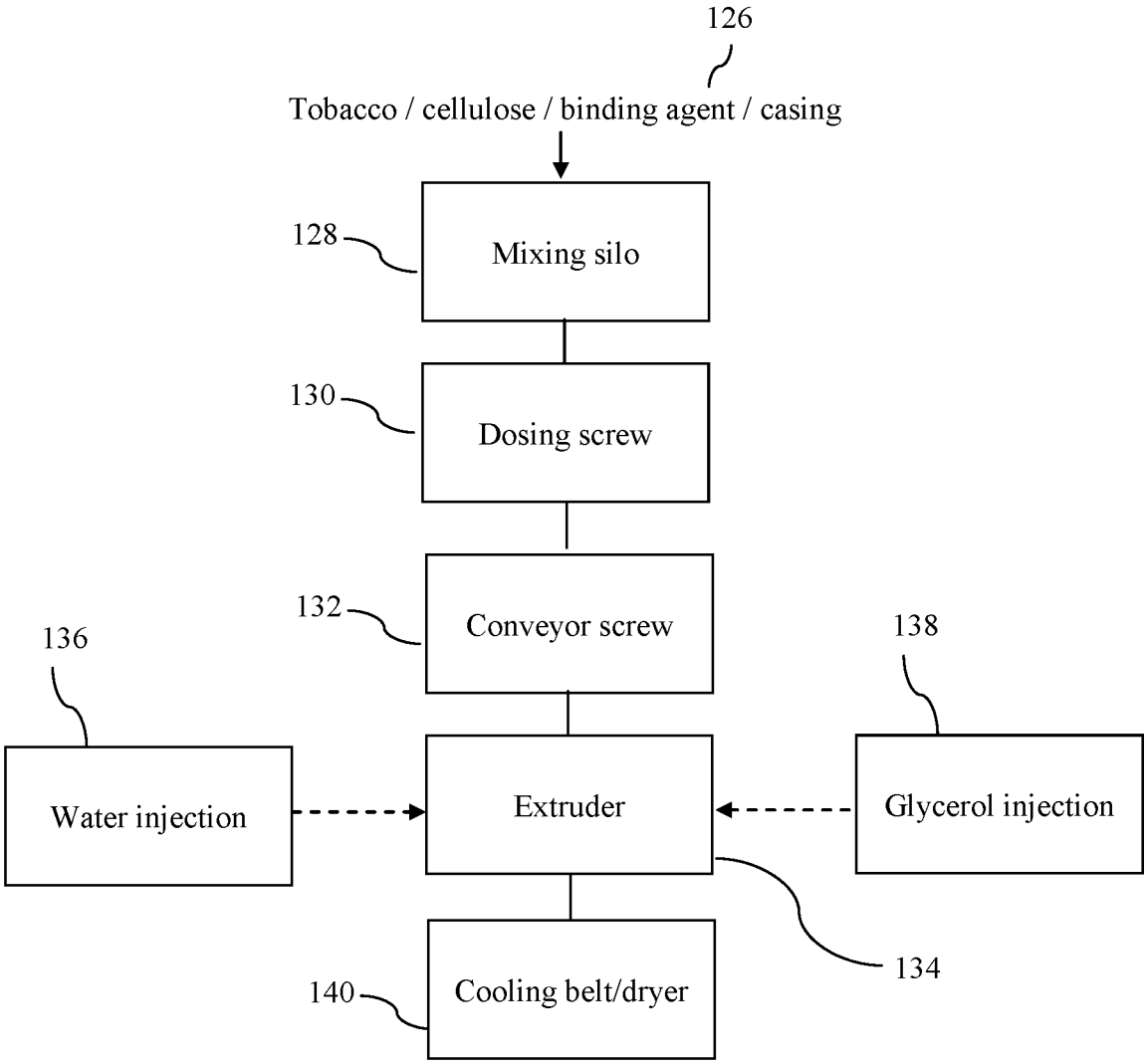
FIG. 2 shows a flowchart for a process for making extruded tobacco.

As shown in FIG. 2, the furnished tobacco 126 and any additional components are mixed in a mixing silo at 128, and conveyed by a dosing screw at 130 and conveyor screw 132 to an extruder at 134, where they are mixed with water 136, and at this stage an aerosol generating agent such as glycerol may also be added at 138. After extrusion, the extruded tobacco is cooled on a cooling belt at 140.

Figure 3:
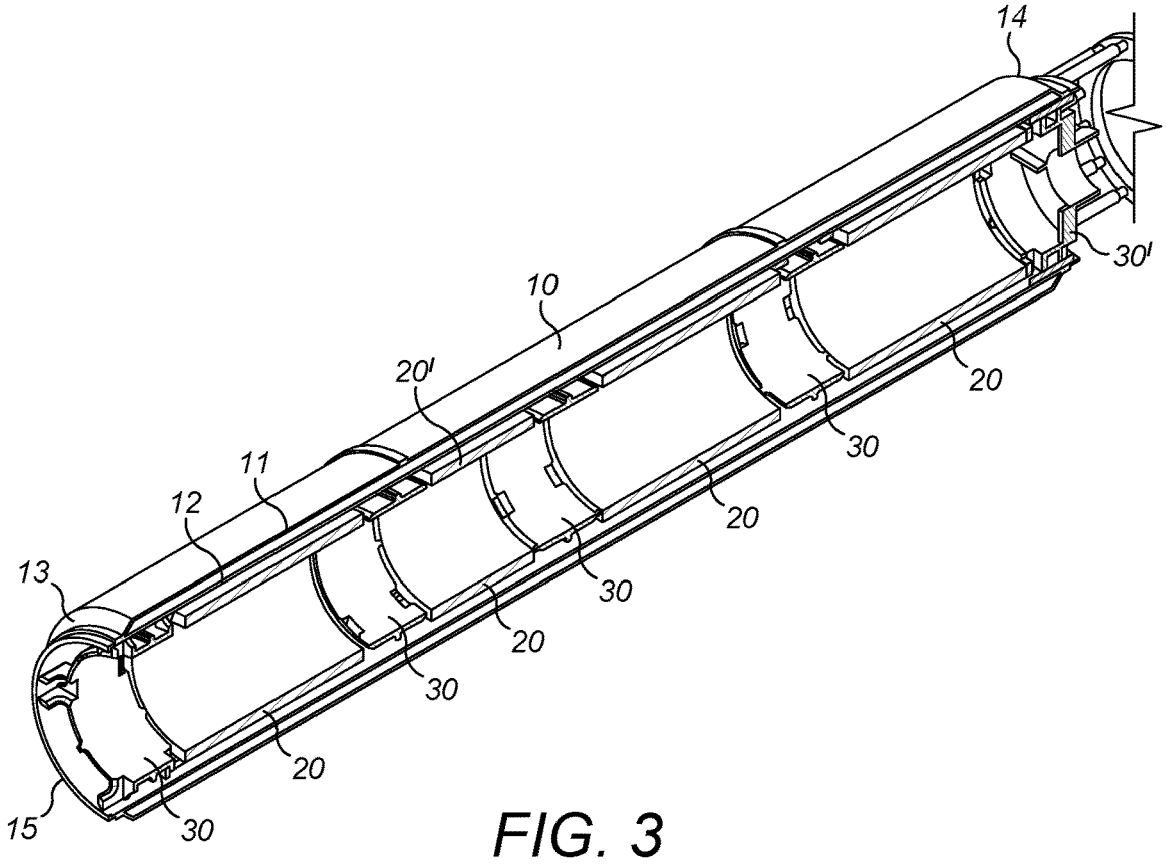
FIG. 3 shows an apparatus for making extruded tobacco.

The extruder is shown schematically in FIG. 3. Referring to FIG. 3, tobacco furnish (and any additional components) are added in the tobacco feeding zone 1, and conveyed through screw within housing 2 to extruder head 3 provided with tool set 4 and hydraulic cylinder 5. Water is injected at 6 and aerosol generating agent such as glycerol at 7. Along the screw housing 2 are provided temperature sensors 8, 9, and pressure sensors 10, 11 and 12. The extruded tobacco product is discharged at the discharge zone 13.

Examples of extruded tobacco that may be used are as follows in Table 2.

TABLE 2

Extruded Tobacco

| | | Component Range | | EX-1 | EX-2 |
|---|---|---|---|---|---|
| Type | Ingredient | Low % | High % | ww % | ww % |
| Tobacco | Virginia | 40 | 80 | 42 | 68 |
| | Burley | 0 | 20 | 10 | 10 |
| | Oriental | 0 | 15 | 7 | 7 |
| | Others | 0 | 15 | — | — |
| | Total | | | 59 | 85 |
| Fiber | Cellulose | 0 | 30 | 25 | 0 |
| Binding agent | CMC | 1 | 2 | 2 | 2 |
| Aerosol Agent | Glycerol | 10 | 20 | 14 | 13 |
| Casing/Flavor | — | 0 | 5 | 0 | 0 |
| | Total all | | | 100 | 100 |
| Moisture (water) | | 5 | 15 | 9 | 9 |

An analogous material to those described above in the section, but made using only non-tobacco fibers, such as wheat fiber or wood fiber, may be used in the filler component of the tobacco composition.

Bandcast Tobacco

Bandcast tobacco may optionally be included in the tobacco compositions described herein. If bandcast tobacco is included, it may be present, for example, in an amount of from 10 to 30% by weight, or from 10 to 20% by weight, of the tobacco component.

The bandcast tobacco which may be used in the tobacco compositions described herein may be prepared by methods which are known to those skilled in the art for preparing bandcast tobacco.

A bandcast tobacco may comprise tobacco or tobacco extract (or both), filler, aerosol generating agent (as defined herein), and binder.

The filler as discussed in this section as an ingredient in bandcast tobacco is distinct from the filler component that may be present in the tobacco compositions as defined herein, however similar materials may be used for the filler component.

A bandcast tobacco containing tobacco extract can be prepared as follows.

The tobacco extract may be obtained by a method comprising the treatment of tobacco with a solvent, and may further comprise other treatment steps (such as concentration). The extract may be formed by the treatment of any suitable tobacco, such as single grades or blends, cut rag or whole leaf, including Virginia and/or Burley and/or Oriental tobacco.

In some embodiments, the tobacco extract may be obtained by a method comprising the treatment of tobacco with water. In some embodiments, the treatment of tobacco with water may comprise adding water to tobacco, separating the resulting water-based liquid extract from the insoluble portion of tobacco feedstock, and optionally removing excess water to form a tobacco extract. Any suitable filtration methods may be used, such as centrifugal solids filtration or vacuum fluidized bed filtration. Any suitable evaporative concentration methods may be used, such as vacuum spinning disk, vacuum falling, or rising film evaporation. Techniques including spray-drying or freeze-drying may also be used to reduce/remove water content. Such processes would be known to those skilled in the art of filtration and evaporative concentration. The pH of the tobacco extract may be adjusted to between 6 and 10.5.

In some embodiments, the tobacco extract may be obtained by a method comprising extraction using a supercritical fluid, e.g. supercritical carbon dioxide. In some other embodiments, tobacco extract may be obtained by a method comprising extraction with a solvent which may comprise a polyol or other suitable higher boiling liquids. In some cases, the extraction solvent may comprise glycerol and/or propylene glycol (and optionally water).

In some embodiments, the tobacco extract may be obtained by a method including steam distillation.

In some embodiments, the tobacco extract may be prepared by a method comprising steps for removing or reducing the concentration of certain substances. For example, the tobacco extract may be treated with bentonite to reduce protein content, and/or polyvinylpolypyrrolidone to reduce polyphenol content.

In some embodiments, the tobacco extract may be prepared by a method comprising steps for adding or increasing the concentration of one or more substances. In some of these embodiments, aerosol generating agents and/or flavorings may be added, for example.

A filler may be necessary to give the bandcast tobacco material a dry consistency which means that the material can be processed down-stream (shredded, blended, rolled, crimped, shaped etc.). The filler may comprise one or more inorganic filler materials, which include, but are not limited to: chalk, perlite, vermiculite, diatomaceous earth, colloidal silica, magnesium oxide, magnesium sulphate, magnesium carbonate, and suitable inorganic sorbents, such as molecular sieves. Chalk is particularly suitable. In some cases, the filler may comprise one or more organic filler materials, which include, but are not limited to: wood pulp, cellulose and cellulose derivatives.

In some embodiments, the filler may act as a sorbent and/or support for other substances in the bandcast tobacco. In some embodiments, it may act as a structure for adsorbing other substances before releasing them on heating. In some embodiments, it may act as a sorbent and/or support for an aerosol generating agent (as defined herein).

The binder may comprise one or more of an alginate, celluloses or modified celluloses, starches or modified starches, gelatins and natural or synthetic gums.

Suitable binders include, but are not limited to: alginate salts comprising any suitable cation; celluloses or modified celluloses, such as hydroxypropyl cellulose and carboxymethylcellulose; starches or modified starches; polysaccharides such as pectin salts comprising any suitable cation, such as sodium, potassium, calcium or magnesium pectate; xanthan gum, guar gum, and any other suitable natural gums; and mixtures thereof. In some embodiments, the binder comprises, substantially consists of or consists of one or more alginate salts selected from sodium alginate, calcium alginate, potassium alginate or ammonium alginate.

The bandcast tobacco may further include additional ingredients, such as flavorings (as defined herein) and casings (as defined herein).

The bandcast tobacco may further include heat-conducting particles. These may improve the rate of heat transfer in use through the bandcast tobacco.

In some embodiments, the bandcast tobacco may additionally comprise a further tobacco material in addition to tobacco extract, such as ground tobacco, tobacco fiber, cut tobacco, extruded tobacco, tobacco stem and/or reconstituted tobacco.

The bandcast tobacco may be made from a slurry, the slurry comprising the components of the aerosol generating material and water. In some embodiments, the slurry is extruded or cast and then dried to form the aerosol generating material. In alternative embodiments, the slurry may be sprayed and then dried to form the aerosol generating material. In some embodiments, the method of making the aerosol generating material further comprises the initial step of making the slurry.

To form the slurry, the components of the bandcast tobacco may be added in any suitable order. In some embodiments, the slurry may undergo mixing during and/or after the addition of its components and, in these embodiments, may undergo mixing for any suitable length of time. The length of time over which the slurry undergoes mixing will depend on its composition and volume, and may be varied accordingly. In some embodiments, the slurry may undergo mixing as necessary to make the composition of the slurry substantially homogeneous and to ensure that the slurry has the required flow and viscosity characteristics for casting.

In some embodiments, the method of making a slurry may comprise the steps of (1) mixing the aerosol generating agent and binder, (2) adding water and mixing, (3) adding filler and mixing, (4) adding tobacco extract and mixing to form a smooth slurry. The mixing after addition of tobacco extract will typically be a high shear mixing. In embodiments in which the binder is a solid, step (1) creates a dispersion/suspension of the binder in the aerosol generating agent.

In some embodiments, the method of making a slurry may comprise the steps of (1) adding the binder to the water and mixing, (2) adding the aerosol generating agent and mixing (3) adding filler and mixing, and (4) adding tobacco granules, ground tobacco or tobacco extract, and mixing thoroughly to form a smooth slurry.

The slurry may be cast into a sheet on a casting plate or the band of a bandcasting machine. Then, the slurry may be dried using any suitable method of drying. In some embodiments, the slurry may be dried at room temperature (i.e. about 20-25° C.). In some embodiments, the slurry may be warmed to effect drying. In some embodiments, the slurry may be dried in warm air (i.e. an oven). In some embodiments, plate or band on which the wet slurry is resting may be warmed to effect drying. In embodiments where the slurry is warmed, the slurry may be dried at any suitable temperature for any suitable length of time.

The cast sheet may be removed from the casting plate or band of the bandcasting machine by any suitable method. In some cases, the sheet and plate/band simply separate on application of a force. In some cases, the sheet may be removed using an item for accessing the space between structure and the plate, such as a knife or blade (a "doctoring knife"). Alternatively or in addition, the structure may be removed by increasing the temperature of the contact point between the structure and the plate. In some such embodiments, the structure may be removed from the plate using steam which, in addition to increasing the temperature of the contact point between the structure and the plate, causes sorption of water by the bandcast tobacco which aids its removal.

An example of a bandcast tobacco containing tobacco extract is as follows.

Tobacco Extract

Seven batches of whole leaf Burley tobacco (4.5 kg per batch) were extracted with 80 kg water (Reverse Osmosis quality) at 60° C. for 25-30 minutes with gentle agitation. The resulting mixture was filtered and centrifuged and the combined resulting extracts (480 l) were concentrated using an evaporative concentration process to 41.1% solids content (in this context, 'solids content' refers to the non-aqueous portion of the water extract). The extract had a nicotine content of 3.37% (wet weight basis), and a density of 1.21 g/cm$^3$.

Bandcast Tobacco

Water (756 g—reverse osmosis purified) was placed in a high shear mixer. Whilst mixing, sodium alginate powder (15.01 g) was slowly added, ensuring even mixing and full hydration to a smooth, viscous fluid. Glycerol (24.99 g) was added to the high shear mixer with continuous mixing. Chalk (156.99 g) was then added in a slow powder stream with continuous high shear mixing. Finally, tobacco extract (61.26 g, prepared as above) was added with continuous high shear mixing until a smooth, free flowing slurry was formed.

After a smooth, free flowing slurry had been formed, the material was ready for casting into sheet.

The slurry was then cast onto a stainless steel casting plate at 2 mm thickness using a casting knife. This provided a constant thickness of the slurry which was then dried. Drying can be effected by air drying at ambient conditions for approximately 24 hours or in an oven at about 45-55° C. for 0.5-5 hours (minimum time used to reduce loss of volatiles). The dried sheet was then removed from the plate and conditioned by exposure at 22° C. and 60% relative humidity (RH), for 48 hours. In some cases, the dried sheet was cut off the casting plate using a "doctoring" knife.

The resulting cast tobacco material had a nicotine content of 6.7 mg/g (WWB), 7.15 mg/g (DWB), a glycerol content of 90.3 mg/g (WWB), 96.4 mg/g (DWB), and a water content of 6.3%.

A bandcast tobacco containing tobacco typically comprises tobacco powder, a binder for example modified celluloses such as hydroxypropyl cellulose and carboxymethylcellulose (CMC), organic filler such as woodpulp, and inorganic filler such as chalk. A bandcast tobacco containing tobacco can be prepared as follows.

The organic filler such as wood fiber is pre-refined to the desired specifications, such as fiber length, curl, kink angle etc.

Tobacco (lamina and stem) is ground to a powder with particle size of <200 μm, for example <100 μm. This is added to hydrated binder, organic filler such as wood fiber, and glycerol. Optionally, inorganic filler such as chalk is added.

The resulting slurry is then cast, for example on an endless steel casting belt, and dried as a sheet material that may be further shredded or bobbinized.

Examples of bandcast tobacco containing tobacco that may be used are as follows in Table 3.

TABLE 3

| Ref | Glycerol (%) | Binder CMC (%) | Organic Filler Woodpulp (%) | Tobacco Lamina and stem (%) | Inorganic Filler Chalk (%) |
|---|---|---|---|---|---|
| BC-1 | 19 | 6 | 9 | 56 | 10 |
| BC-2 | 10 | 6 | 9.5 | 74.5 | 0 |
| BC-3 | 20 | 5.5 | 9.5 | 65 | 0 |
| BC-4 | 20 | 5 | 10 | 65 | 0 |
| BC-5 | 15 | 10 | 5 | 60 | 10 |
| BC-6 | 20 | 5 | 10 | 65 | 0 |
| BC-7 | 15 | 5.5 | 9.5 | 70 | 0 |
| BC-8 | 20 | 5 | 5 | 70 | 0 |
| BC-9 | 10 | 9.5 | 5.5 | 75 | 0 |
| BC-10 | 10 | 5 | 5 | 80 | 0 |

Analogous materials to those described above in this section, but without the inclusion of tobacco extract or tobacco powder, may be used in the filler component of the tobacco composition.

Determination of Water Content

In the compositions described herein, the % by weight refers to a dry weight basis, unless specifically indicated to the contrary. Thus, any water that may be present in the tobacco composition, or in any component thereof, is entirely disregarded for the purposes of the determination of the weight %. However, other liquid components, such as the aerosol generating agent, are included in the weight %. The water content of the tobacco compositions described herein may vary and may be, for example, from 5 to 15% by weight. The water content can be determined by Karl-Fisher analysis, or by gas chromatography (GC).

Water Content by Karl-Fisher Analysis

Karl Fisher water analysis was performed on a Mettler Toledo Karl Fisher V30 Volumetric Titrator. Prior to sample testing the background water content of the extraction solvent (methanol) was determined and the value recorded in the analysis method.

Approximately 0.5 g of material to be analyzed was accurately weighed (4 decimal places) into a 100 ml conical flask and the weight recorded. 50 mL of dry methanol was dispensed into the conical flask which was then sealed and agitated on a flatbed shaker (155 rpm) for 30 minutes. Approximately 2 mL of the sample extract was taken up in a syringe and injected into the titration apparatus (weight determined by back weighing of syringe).

Results were reported as the % water content of the sample by weight. Samples were determined in triplicate and the averaged values reported along with the standard deviation.

Water Content by Gas Chromatography

GC Method—Brief Description:

2.0000 g+0.1 g of sample is weighed into a 150 ml conical flask.

To this is added 50 mL of extraction solution (HPLC grade methanol with 1.5 mg/mL n-heptadecane and 1.5 mg/mL IPA internal standards).

The flask is then stoppered and placed on a shaker (orbital or reciprocal) for 4 hours at 160 rpm.

The flask is then taken off the shaker and allowed to stand for 1 hour before an aliquot of the extract is transferred to a GC vial.

The extract in the GC vial is analyzed on a dual column GC (see Table 4 below for parameters) against working calibration solutions that have been previously prepared (see Table 5 below).

TABLE 4

GC Acquisition Method Parameters

| | To Thermal Conductivity Detector | | To Flame Ionization Detector |
|---|---|---|---|
| Inlet | | | |
| Mode | Splitless | | Split |
| Liner | 4 mm Straight w glass wool plug | | 4 mm Straight w glass wool plug |
| Temperature (° C.) | 250 | | 250 |
| Carrier Gas | Helium | | Helium |
| Pressure (psi) | 5.7 | | 16.4 |
| Split Ratio | n/a | | 20:1 |
| Split Flow (mL · min$^{-1}$) | n/a | | 30.0 |
| Pulse Pressure (psi) | n/a | | n/a |
| Pulse Time (min) | n/a | | n/a |
| Injection Volume (μL) | 1.0 | | 1.0 |
| Column | | | |
| Model | CP PORAPlot Q | | DB-WAXETR |
| Dimensions L(m), d(μm), film thickness(μm) | 27.5, 530, 20 | | 30, 250, 0.25 |
| Mode | Constant Flow | | Constant Flow |
| Initial Flow (mL · min$^{-1}$) | 6.5 | | 1.5 |
| Initial Pressure (psi) | 5.7 | | 16.4 |
| Oven Program | | | |
| Temperature (° C.) | 50 | 155 | 245 |
| Hold Time (min) | 1.00 | 2.00 | 4.00 |
| Rate (°C. · min$^{-1}$) | 15.00 | 30.00 | |
| Detector | TCD | | FID |
| Temperature | 250 | | 300 |
| Reference Flow (mL · min$^{-1}$) | 30.0 | | n/a |
| Hydrogen Flow (mL · min$^{-1}$) | n/a | | 30.0 |

TABLE 4-continued

| GC Acquisition Method Parameters | | |
|---|---|---|
| | To Thermal Conductivity Detector | To Flame Ionization Detector |
| Air Flow (mL · min$^{-1}$) | n/a | 400.0 |
| Mode | Const column + make up | Const column + make up |
| Make up Gas | Helium | Nitrogen |
| Combined Flow (mL · min$^{-1}$) | 10.0 | 15.0 |

TABLE 5

| Working Calibration Solution Details | | | | | | |
|---|---|---|---|---|---|---|
| Analyte | Cal 1 | Cal 2 | Cal 3 | Cal 4 | Cal 5 | Cal 6 |
| Nicotine (mg/mL) | 0.05 | 0.10 | 0.25 | 0.5 | 0.75 | 1.00 |
| Menthol (mg/mL) | 0.05 | 0.10 | 0.25 | 0.5 | 0.75 | 1.00 |
| 1,2-Propanediol (mg/mL) | 0.5 | 1.0 | 2.5 | 5.0 | 7.5 | 10.0 |
| Glycerol (mg/mL) | 0.5 | 1.0 | 2.5 | 5.0 | 7.5 | 10.0 |
| Water (mg/mL) | 0.0 | 2.0 | 4.0 | 6.0 | 8.0 | 10.0 |

Device for Generating an Inhalable Aerosol

The tobacco compositions described herein can be used in a device for generating an inhalable aerosol. The device comprises a tobacco composition as described herein and a heating means which volatilizes components in use to form an aerosol. A variety of such devices are known in the art, and an example is disclosed in PCT/EP2014/072828, the entirety of which is hereby expressly incorporated by reference. FIGS. 1 and 2 of PCT/EP2014/072828 are reproduced below, as FIGS. 6 and 7 of the instant application.

In some embodiments, the heating means is an electrical heating means. In some embodiments, the electrical heating means is an electrically resistive heating element. In some embodiments, the heating of the aerosol generating material does not result in any significant combustion of the material. In some embodiments, the heating results in no combustion or essentially no combustion of the aerosol generating material. In some embodiments, the device is a heat not burn device, also known as a tobacco heating device or a tobacco heating product. Such devices are non-combustion type smoking articles, developed as an alternative to conventional, combustible cigarettes. These devices volatilize components of tobacco by heating the tobacco material; pyrolysis or combustion of the tobacco or volatiles is avoided. The volatized components condense to form an inhalable aerosol. The aerosol often comprises water, aerosol generating agent (as defined herein), nicotine and optionally other tobacco components such as flavors and aromas. Thus, in some embodiments, the device is one in which tobacco is heated to volatilize components without pyrolysis or combustion of the tobacco.

Using electricity to heat a tobacco composition in a smoking article has many advantages. In particular, it has many advantages over using combustion. Combustion is a complex process that generates aerosols by a combination of interactive physico-chemical processes which may include oxidative degradation, pyrolysis, pyrosynthesis, and distillation. It generally leads to the generation of complex aerosols. For example, smoke arising from a combustible smoking article comprising tobacco is a complex, dynamic mixture of more than 5000 identified constituents. The exothermic processes of combustion may be self-sustaining, and may result in heat generation rates, and heat output quantities, sufficient for degradation of the combustible matrix. In some cases, the matrix may be completely degraded to an ash residue which may comprise inorganic, non-combustible materials. Very high temperatures can be reached in burning cigarettes due to the exothermic reaction of combustion. In between taking puffs of a cigarette (the inter-puff smoldering period), the center of the burning zone in the tobacco rod of the cigarette can reach temperatures as high as 800° C. During taking a puff of a cigarette, the periphery of the burning zone in the tobacco rod of the cigarette can reach temperatures as high as 910° C.

Using electrical resistance heating systems (such as some heat not burn devices, also known as tobacco heating products or tobacco heating devices) is advantageous because the rate of heat generation is easier to control, and lower levels of heat are easier to generate, compared with using combustion for heat generation. In some embodiments, the device includes an actuator, which allows the user to initiate electrical heating.

The use of electrical heating systems therefore allows greater control over the generation of an aerosol from a tobacco composition. Furthermore, it allows for aerosol to be generated without combustion taking place, rather than through combustive degradation.

In some embodiments, devices can provide multiple deliveries or doses of aerosol. This means that the tobacco composition may be heated to produce sufficient aerosol to allow multiple puffs. This may be achieved by heating the tobacco composition for a period of time sufficient to produce a volume of aerosol suitable for multiple deliveries. In some embodiments, this may involve heating the tobacco composition constantly. Alternatively, this may involve successive, shorter periods of heating the tobacco composition, optionally with each period producing a single delivery or dose of aerosol.

In some embodiments, the device may be configured to heat the tobacco composition to a temperature of between about 50-350° C., 100-350° C., 150-350° C., 150-330° C., or 180-300° C.

In some embodiments, the tobacco composition, or smokable material comprising the tobacco composition, may be provided in a cartridge, and the cartridge may be insertable into the device. In some of these embodiments, this cartridge may be replaceable. In some embodiments, the cartridge may be combined with other parts of the aerosol generating device in any suitable way. In some embodiments, it may be attached to other parts of the device by a friction fit and/or a screw fit and/or a press fit. Thus, the tobacco composition may be provided in a smoking article which is consumable, to be used in conjunction with an apparatus for heating smokable material.

Smoking Article

As used herein, the term "smokable material" includes materials that provide volatilized components upon heating, typically in the form of an aerosol. "Smokable material" includes any tobacco-containing material and may, for example, include one or more of tobacco, tobacco derivatives, expanded tobacco, shredded tobacco, reconstituted tobacco or tobacco substitutes, not restricted to the tobacco compositions that are described herein. "Smokable material" also may include other, non-tobacco, products, which, depending on the product, may or may not contain nicotine.

Apparatus is known that heats smokable material to volatilize at least one component of the smokable material, typically to form an aerosol which can be inhaled, without burning or combusting the smokable material. Such apparatus is sometimes described as a "heat-not-burn" apparatus or a "tobacco heating product" or "tobacco heating device" or similar. The apparatus is typically generally elongate, having an open end, sometimes referred to as the mouth end. The smokable material may be in the form of or provided as part of a cartridge or cassette or rod which can be inserted into the apparatus. A filter arrangement may be provided at the mouth end to filter and/or cool volatilized material as the material is drawn by the user. A heater for heating and volatilizing the smokable material may be provided as a "permanent" part of the apparatus or may be provided as part of the smoking article or consumable which is discarded and replaced after use. A "smoking article" in this context is a device or article or other component that includes the smokable material, which in use is heated to volatilize the smokable material, and optionally other components. In use, particularly in the present principal applications, the smokable material is not burnt or combusted. The tobacco compositions described herein are particularly useful in such smoking articles, and the smokable material can contain the tobacco compositions.

Figure 4:
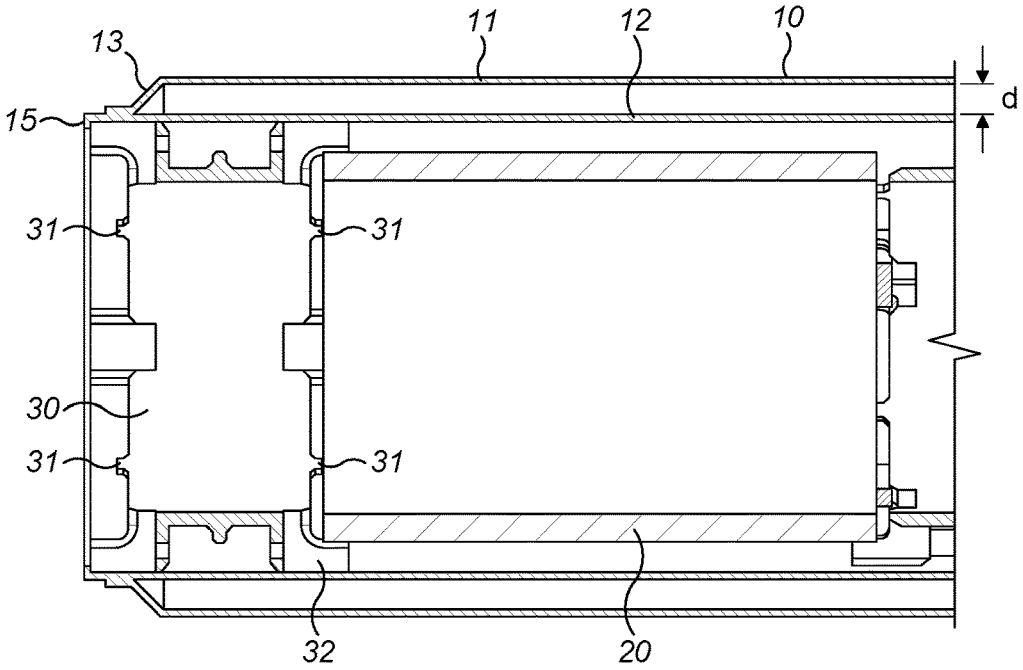
FIG. 4 shows an embodiment of a smoking article containing a tobacco composition as described herein.

Referring now to FIG. 4, there is shown schematically an example of a consumable 100 for use with an apparatus for heating smokable material. The consumable 100 has a mouthpiece 101 and a cylindrical rod of smokable material 102.

The mouthpiece 101 may be formed of for example paper, for example in the form of a spirally wound paper tube, cellulose acetate, cardboard, crimped paper, such as crimped heat resistant paper or crimped parchment paper, and polymeric materials, such as low density polyethylene (LDPE), or some other suitable material. The mouthpiece 101 may comprise a tube. The tube may be a hollow tube. Such a hollow tube may provide a filtering function to filter volatilized smokable material. As shown, the mouthpiece 101 may be elongate, in order to be spaced from the very hot part(s) of the main apparatus that heats the smokable material.

In an embodiment not shown, the mouthpiece may contain a filter element. The filter element may be a filter plug, and may be made, for example, from cellulose acetate. The filter element, if present, may be located at the downstream end of the mouthpiece.

Figure 5:
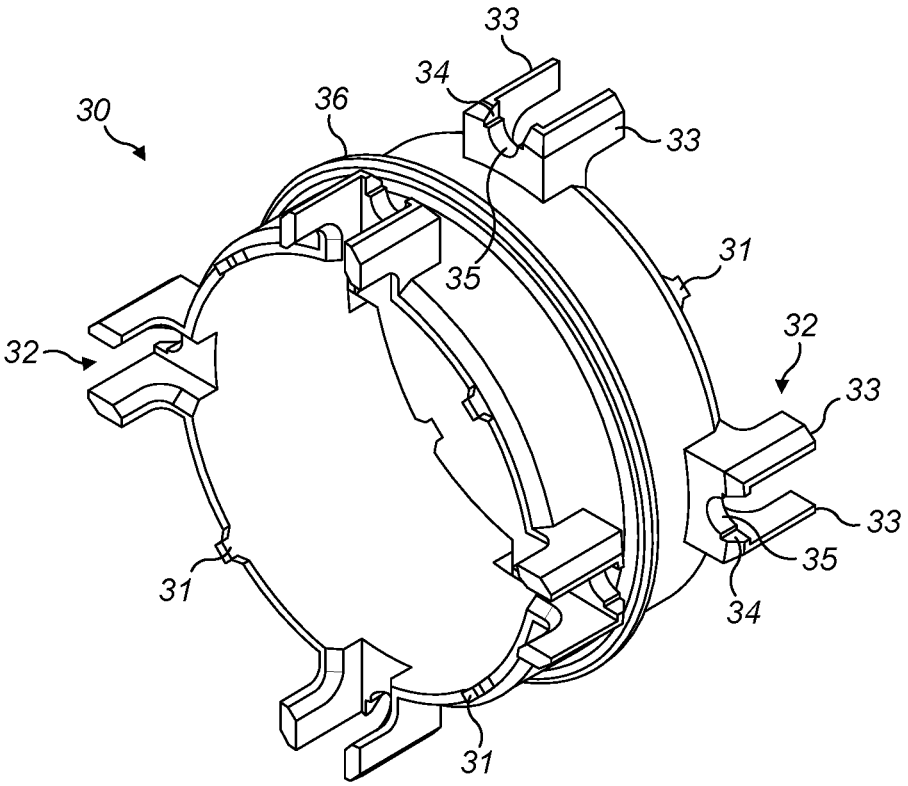
FIG. 5 shows a further embodiment of a smoking article containing a tobacco composition as described herein and containing an aerosol cooling element.

Referring now to FIG. 5, the mouthpiece assembly 201 may include a cooling element 204. The element 204 may be a monolithic rod having first and second ends and comprising plural through holes extending between the first and second ends. As shown in FIG. 5, on the other side of the cooling element 204 may be a second hollow tube 206 which spaces the cooling element 204 from the very hot part(s) of the main apparatus that heats the smokable material and thus protects the cooling element 204 from high temperatures, as well as helping to improve aerosol production as it can help to prevent condensation. The second tube 206 may again be formed of for example paper, for example in the form of a spirally wound paper tube, cellulose acetate, cardboard, crimped paper, such as crimped heat resistant paper or crimped parchment paper, and polymeric materials, such as low density polyethylene (LDPE), or some other suitable material. The mouth end tube 205 and the second tube 206 provide support for the cooling element 204. The mouth end tube 205 may have a filtering function and may sometimes be referred to as a tube filter.

The cooling element 204 in this example is located generally centrally of the mouthpiece assembly 201, but in other examples may be located more or less towards one end or the other of the mouthpiece assembly 201. In the example of FIG. 5, the mouth end tube 205, the cooling element 204 and the second tube 206 are held together by a tipping paper 203 which is wrapped tightly round the mouth end tube 205, the cooling element 204 and the second tube 206 to bind them together. In this sense, the mouthpiece assembly 201 is "pre-assembled".

In one specific example, the first, mouth end tube 205 may be 11 mm long, the cooling element 204 may be 19 mm long, and the second tube 206 may be 11 mm long, and the outside diameter of the mouthpiece assembly 201 as a whole may be 5.4 mm. Excluding the tipping paper 203, the outside diameter of the cooling element 204, the mouth end tube 205 and the second tube 206 may for example be in the range 5.13 mm to 5.25 mm, with 5.25 mm being one preferred option. Other dimensions may be used, depending on for example the particular application, the typical temperature of the incoming aerosol or vapor, the nature (material) of the aerosol or vapor and smokable material, etc.

As also shown in FIG. 5, the mouthpiece assembly 201 may then be joined to the smokable material 202 by a further tipping paper 207, which is wrapped round the mouthpiece assembly 201 and at least the adjacent end of the smokable material 202. In other examples, the mouthpiece assembly 201 is not pre-assembled and instead the consumable 200 is formed by wrapping a tipping paper 207 around the cooling element 204, the mouth end tube 205, the second tube 206 and the smokable material 202 effectively in one operation, with no separate tipping paper being provided for the components of the mouthpiece parts.

As shown in FIG. 5, the mouthpiece assembly 201 may include a cooling element. The cooling element has through holes, which may extend substantially parallel to the central longitudinal axis of the rod.

The through holes may be arranged generally radially of the element when viewed in lateral cross-section. That is, in an example, the element has internal walls which define the through holes and which have two main configurations, namely radial walls and central walls. The radial walls extend along radii of the cross-section of the element and the central walls are centered on the center of the cross-section of the element. The central walls in one example are circular, though other regular or irregular cross-sectional shapes may be used. Likewise, the cross-section of the element in one example is circular, though other regular or irregular cross-sectional shapes may be used.

In an embodiment, the majority of the through holes have a hexagonal or generally hexagonal cross-sectional shape. In this embodiment, the element has what might be termed a "honeycomb" structure when viewed from one end.

The element may be substantially incompressible. It may be formed of a ceramic material, or of a polymer, for example a thermoplastic polymer, which may be an extrudable plastics material.

In an embodiment, the porosity of the element is in the range 60% to 75%. The porosity in this sense may be a measure of the percentage of the lateral cross-sectional area of the element occupied by the through holes. In an embodiment, the porosity of the element is around 69% to 70%.

Other embodiments of aerosol-cooling element are disclosed in PCT/GB2015/051253, the entirety of which is hereby expressly incorporated by reference, in particular in FIGS. 1 to 8 and the description from page 8, line 11 to page 18, line 16.

In further embodiments, the aerosol-cooling element may be formed from a sheet material that is folded, crimped or pleated to form through holes. The sheet material may be made, for example, from metal such as aluminum; polymeric plastics material such as polyethylene, polypropylene, polyethylene terephthalate, or polyvinyl chloride, or paper.

Figure 6:
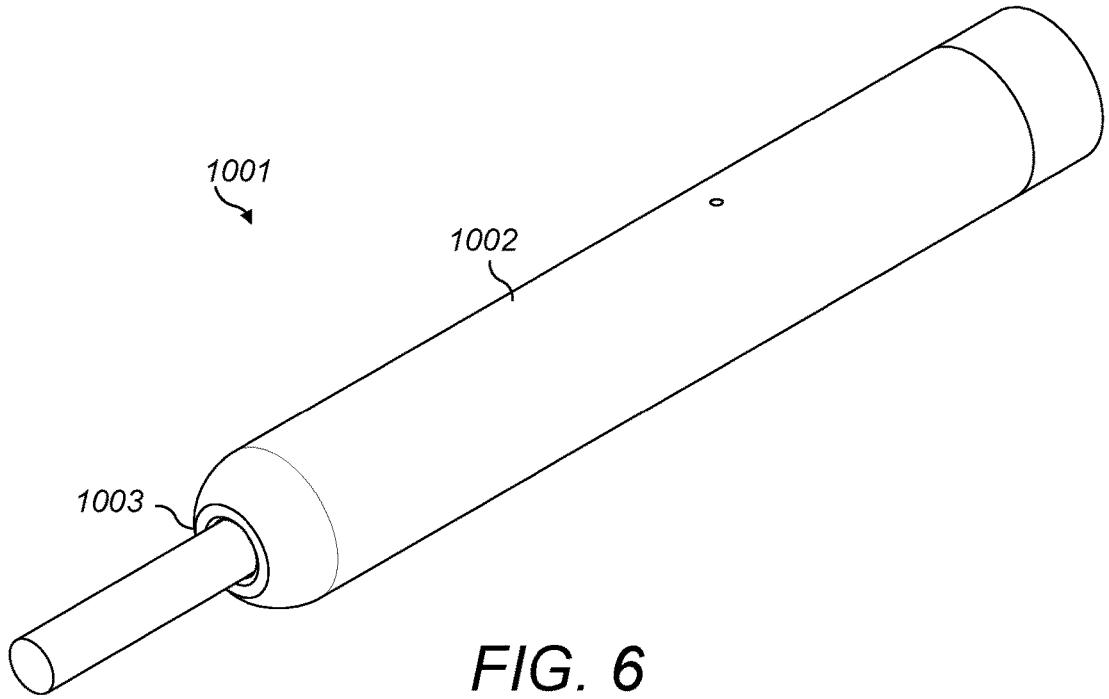
FIG. 6 shows a perspective view of an example of an apparatus for heating a smokable material.
Figure 7:
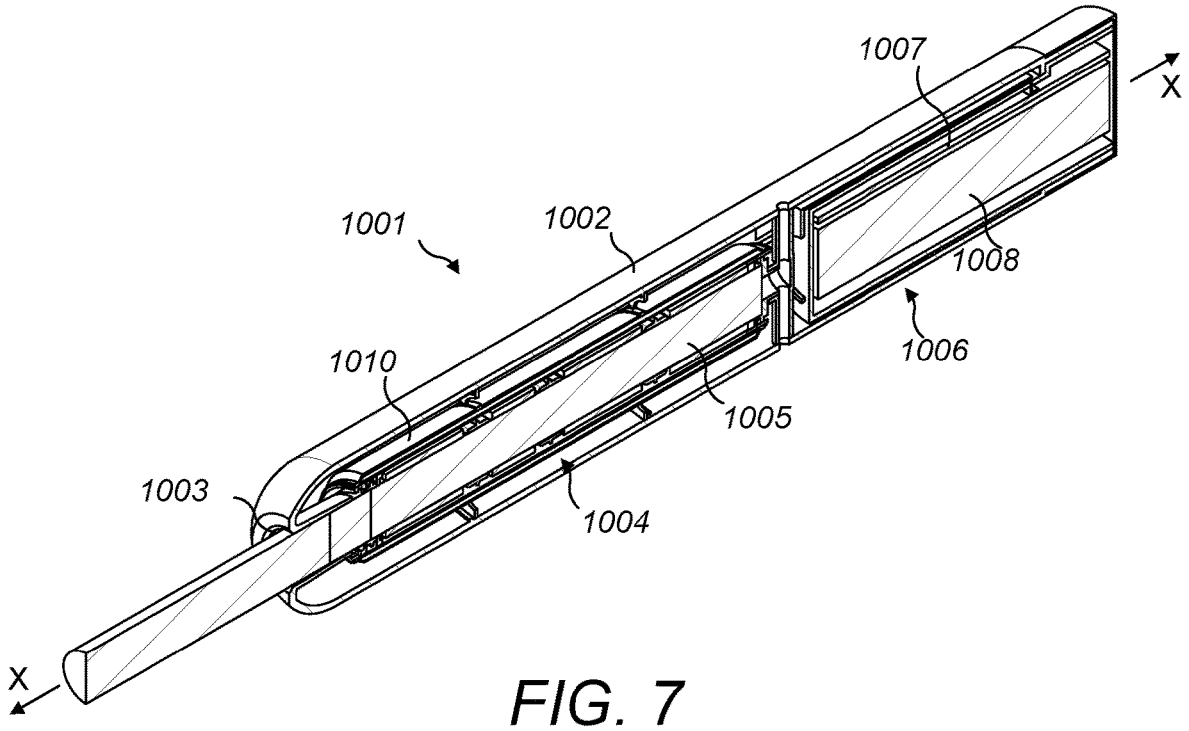
FIG. 7 shows a cross-sectional perspective view of the apparatus of FIG. 6.

Referring to FIG. 6, there is shown a perspective view of an example of an apparatus 1001 arranged to heat smokable material to volatilize at least one component of said smokable material, typically to form an aerosol which can be inhaled. The apparatus 1001 is a heating apparatus 1001 which releases compounds by heating, but not burning, the smokable material. The apparatus 1001 in this example is generally elongate, having a generally elongate cylindrical outer housing 1002 of circular cross-section. The outer housing 1002 has an open end 1003, sometimes referred to herein as the mouth end. Referring particularly to the cross-sectional view of FIG. 7, the apparatus 1001 has a heating chamber 1004 which in use contains the smokable material 1005 to be heated and volatilized. The smokable material 1005 may be in the form of a cartridge or cassette or rod which can be inserted into the apparatus 1001. An end of the smokable material 1005 projects out of the apparatus 1001 through the open end 1003 of the housing 1002, typically for connection to a filter or the like, which may be a separate item or provided with the smokable material 1005, through which a user inhales in use. The apparatus 1001 further has an electronics/power chamber 1006 which in this example contains electrical control circuitry 1007 and a power source 1008. In this example, the heating chamber 1004 and the electronics/power chamber 1006 are adjacent each other along the longitudinal axis X-X of the apparatus 1001. In the example shown, the electronics/power chamber 1006 is remote from the mouth end 1003, though other locations are possible. The electrical control circuitry 1007 may include a controller, such as a microprocessor arrangement, configured and arranged to control the heating of the smokable material as discussed further below. The power source 1008 may be a battery, which may be a rechargeable battery or a non-rechargeable battery. Examples of suitable batteries include for example a lithium-ion battery, a nickel battery (such as a nickel-cadmium battery), an alkaline battery and/or the like. A particularly preferred type of battery is a LiFeP04 battery. The battery 1008 is electrically coupled to the one or more heating elements (to be discussed further below) of the heating chamber 1004 to supply electrical power when required and under control of the electrical control circuitry 1007 to heat the smokable material (as discussed, to volatilize the smokable material without causing the smokable material to burn). In this example, the battery 1008 is contained within a printed circuit board of the electrical control circuitry 1007. In other examples, the battery 1008 and the electrical control circuitry 1007 may be arranged differently, such as for example arranged adjacent each other along the longitudinal axis X-X of the apparatus 1001. The heating chamber 1004 is contained within a heater support sleeve 1010, which is contained within the outer housing 1002. In this example, the heater support sleeve 1010 is a generally elongate cylinder of circular cross-section.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed embodiments. Various embodiments may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A tobacco heating product device for generating an inhalable aerosol, the device comprising a tobacco composition and a heating means configured to volatilize components of the tobacco composition to form an aerosol, the tobacco heating product device configured to heat but not burn the tobacco composition, the tobacco composition comprising:

a tobacco component in an amount of from 60 to 90% by weight of the tobacco composition, a filler in an amount of from 0 to 20% by weight of the tobacco composition, and an aerosol generating agent;

wherein the tobacco composition has a nicotine content of from 0.5 to 1.5% by weight of the tobacco composition;

wherein the tobacco component comprises paper reconstituted tobacco in an amount of from 70 to 100% by weight of the tobacco component and wherein the paper reconstituted tobacco comprises concentrated tobacco solubles;

wherein the aerosol generating agent comprises glycerol in an amount from 13% to 16% of the tobacco compositions, wherein the device is configured to heat the tobacco composition to a temperature of between 300° C. to 350° C., and wherein the tobacco component contains bandcast tobacco in an amount of from 10 to 30% by weight of the tobacco composition.

2. The device according to claim 1, wherein the tobacco component further includes one or more additional components selected from the group consisting of leaf tobacco, extruded tobacco, and mixtures thereof, in an amount of from 0 to 30% by weight of the tobacco component.

3. The device according to claim 1 wherein the tobacco component contains leaf tobacco in an amount of from 10 to 30% by weight of the tobacco composition.

4. The device according to claim 1, wherein the tobacco component contains extruded tobacco in an amount of from 10 to 30% by weight of the tobacco composition.

5. The device according to claim 1, wherein the heating means is an electrical heating means.

6. The device according to claim 5, wherein the electrical heating means is an electrically resistive heating element.

7. The device according to claim 1, wherein the tobacco composition is provided in a smoking article comprising smokable material comprising the tobacco composition, and a mouthpiece is attached to one end of the smokable material.

8. The device according to claim 7, wherein the mouthpiece comprises a hollow tube.

9. The device according to claim 7, further comprising an aerosol-cooling element between the smokable material and the mouthpiece configured to cool smokable material produced when the smokable material is heated.

10. The device according to claim 9, comprising a spacer between the smokable material and the aerosol-cooling element.

11. The device according to claim 10, wherein the spacer is a hollow spacer tube.

12. The device according to claim 1, wherein the paper reconstituted tobacco contains casing and/or flavors.

* * * * *